US005085367A

United States Patent [19]

Carstens

[11] Patent Number: 5,085,367

[45] Date of Patent: Feb. 4, 1992

[54] CORRUGATED CARDBOARD BOXES WITH INCREASED COMPRESSION STRENGTH

[76] Inventor: Ronald Carstens, 209 Edith Point, Anacortes, Wash. 98221

[21] Appl. No.: 695,527

[22] Filed: May 3, 1991

[51] Int. Cl.[5] ..... B65D 5/42

[52] U.S. Cl. ..... 229/3.5 R; 229/919; 229/DIG. 2; 229/DIG. 4; 493/63; 493/148

[58] Field of Search ..... 229/3.5 R, 915, 919, 229/DIG. 2, DIG. 4; 220/441, 443; 493/59, 63, 448, 160

[56] References Cited

U.S. PATENT DOCUMENTS

| | | | |
|---|---|---|---|
| 456,597 | 7/1891 | Remus . | |
| 1,158,130 | 10/1915 | Hawkins . | |
| 1,771,760 | 7/1930 | MacLellan . | |
| 2,625,315 | 1/1953 | Fehrenkamp | 229/DIG. 4 |
| 2,676,745 | 4/1954 | Geisler . | |
| 3,100,072 | 8/1963 | Mason . | |
| 3,137,436 | 6/1964 | Moors et al. . | |
| 3,228,710 | 1/1966 | Chodorowski . | |
| 3,305,383 | 2/1967 | Gordy . | |
| 3,307,994 | 3/1967 | Scott, Jr. | 229/3.5 R |
| 3,365,111 | 1/1968 | McNair, Jr. et al. . | |
| 3,411,689 | 11/1968 | Brackett | 229/3.5 R |
| 3,421,678 | 1/1969 | Thompson et al. . | |
| 3,482,278 | 12/1969 | Thompson et al. . | |
| 3,899,123 | 8/1975 | Stollberg et al. | 229/DIG. 4 |
| 3,913,826 | 10/1975 | Brownlee et al. . | |
| 3,955,746 | 5/1976 | Engman . | |
| 4,032,053 | 6/1977 | Wilson | 229/DIG. 4 |
| 4,586,643 | 5/1986 | Halabisky et al. . | |

FOREIGN PATENT DOCUMENTS

| | | | |
|---|---|---|---|
| 2037226 | 7/1980 | United Kingdom | 229/DIG. 2 |

*Primary Examiner*—Gary E. Elkins

*Attorney, Agent, or Firm*—Fleit, Jacobson, Cohn, Price, Holman & Stern

[57] ABSTRACT

To increase the compression strength of a corrugated cardboard box, the horizontal edges of the box are perforated and the vertical edges are chemically treated. Surprisingly, the combination of mechanical and chemical treatments increases the compression strength more than the figure obtained by adding the percentage strength increases attributable to the individual treatments.

10 Claims, 1 Drawing Sheet

CORRUGATED CARDBOARD BOXES WITH INCREASED COMPRESSION STRENGTH

BACKGROUND OF THE INVENTION

This invention relates to a means and method for increasing compression strength of corrugated cardboard boxes.

In the past, compression strength of corrugated boxes has been determined primarily by the weight of the linerboards used in their manufacture. Appropriate combinations of the liner weights of the three layers of corrugated board may be used to achieve a desired compression strength. In general, the heavier the combined board weights, the higher is the compression strength of the box.

More recently, efforts have been made to increase the compression strength of boxes by using linerboard manufactured by various methods which result in the use of less or equivalent fiber, while providing increased compressive strength. There are several methods currently employed. One method makes use of board which is manufactured using specialized machinery which allows the paper fibers to orient themselves predominantly in the machine direction. This method produces board of increased strength by utilizing the strength intrinsic to the fiber's directional mode. To effect this result, specialized machinery and manufacturing processes are required. Another method employed, which also requires specialized machinery, is to press the board such as to increase the density, while reducing the finished board moisture content resulting also in greater compressive strength. These methods can result in compression strength increases in the order of 10–20%.

Other methods rely on chemical impregnation or saturation of the sheet with resins or inorganic salts which form paper/chemical composites which have greater stiffness and compressive strength. Using such methods the entire linerboard is subjected to chemical treatment. Problems resulting from these methods include difficulty in being able to glue the board in box manufacturing operations, as well as cracking of the score lines resulting from the increased stiffness. In the case of saturation with salt solutions, the only successful methods have relied on use of saturating equipment usually beyond the economic constraints of most box manufacturers.

SUMMARY OF THE INVENTION

Known methods of increasing box compression strength generally have relied on increasing the compressive strength of the paper used in the box manufacture. This invention utilizes methods specific to the box itself and does not require treatment, either chemical or mechanical, of the paper before fabrication of the box. Rather the invention relies on treatments to the produced, finished box. Moreover, the treatment is only to specific areas of the box, while former methods required chemical treatment of the entire box liner.

Using current state-of-the-art methods, boxes are sometimes perforated along score lines in order to make boxes stronger. This invention provides a combination of mechanical perforation of horizontal score lines of a box and chemical treatment of interior vertical box corners to produce increased compression strength of the box. Surprisingly, the increased strength is found to be greater than the sum of strength increases resulting from the use of either treatment alone.

When chemical treatment of the vertical corners alone is used, an increase of approximately 10–15% in compression strength results compared to an untreated box. When perforations alone are used on the horizontal scores, an increase of 10–15% in box compression results. When the two methods are combined, however, increased compression strength of as much as 39% can be realized. As a specific example of this invention, ten regular slotted containers (RSC) boxes were sealed and subjected to compression testing. The resulting average compression resistance of the ten boxes was 666 pounds.

Ten more boxes of the same type from the same run were set up. Before sealing, only the internal vertical corners were coated with a chemical strength enhancer composed of urea formaldehyde resin similar to Beetle 60, manufactured by American Cyanamid. The boxes were then sealed and allowed to cure overnight. The average result of compression testing was 734# or 10% higher than untreated cartons.

Ten more boxes were mechanically altered such that the horizontal scores were perforated but the boxes were not chemically treated. The boxes were then sealed. The resulting average compression strength was 803#, or 21% higher than boxes without treatment.

Ten additional boxes were subjected to the combined chemical and mechanical treatments described above with the surprising average compression result of 924#, or 39% higher than boxes with no treatment. This result was thus higher than the value of approximately 30% to be expected by "adding" the 10% from chemical modification and 21% from mechanical modification.

Benefits resulting from the combined chemical/mechanical treatment include, for example:

- A lighter weight board can be used for boxes which, after treatment, would have comparable compressive strength to boxes of heavier board, resulting in a saving of material and overall shipping weight.
- A container, after treatment, would be suitable for shipment of greater weight commodities, due to its increased compression strength.
- Boxes/pallets can be stacked higher without crushing, saving warehouse and shipping space.
- Pallets can be stacked higher, making a percentage decrease in amount of time required to load containers for transport, resulting in lower cost and monetary savings.

The quantity of resin required to increase strength with the instant method, as opposed to chemical treatment of the entire liner board is reduced substantially, resulting in substantial savings.

Problems encountered with the known method, which requires chemical impregnation of the sheet producing difficulty in glueability of the board during box manufacturing operations and resulting cracking on score lines, are largely eliminated.

BRIEF DESCRIPTION OF DRAWINGS

The single

DESCRIPTION OF PREFERRED EMBODIMENT

Figure 1:
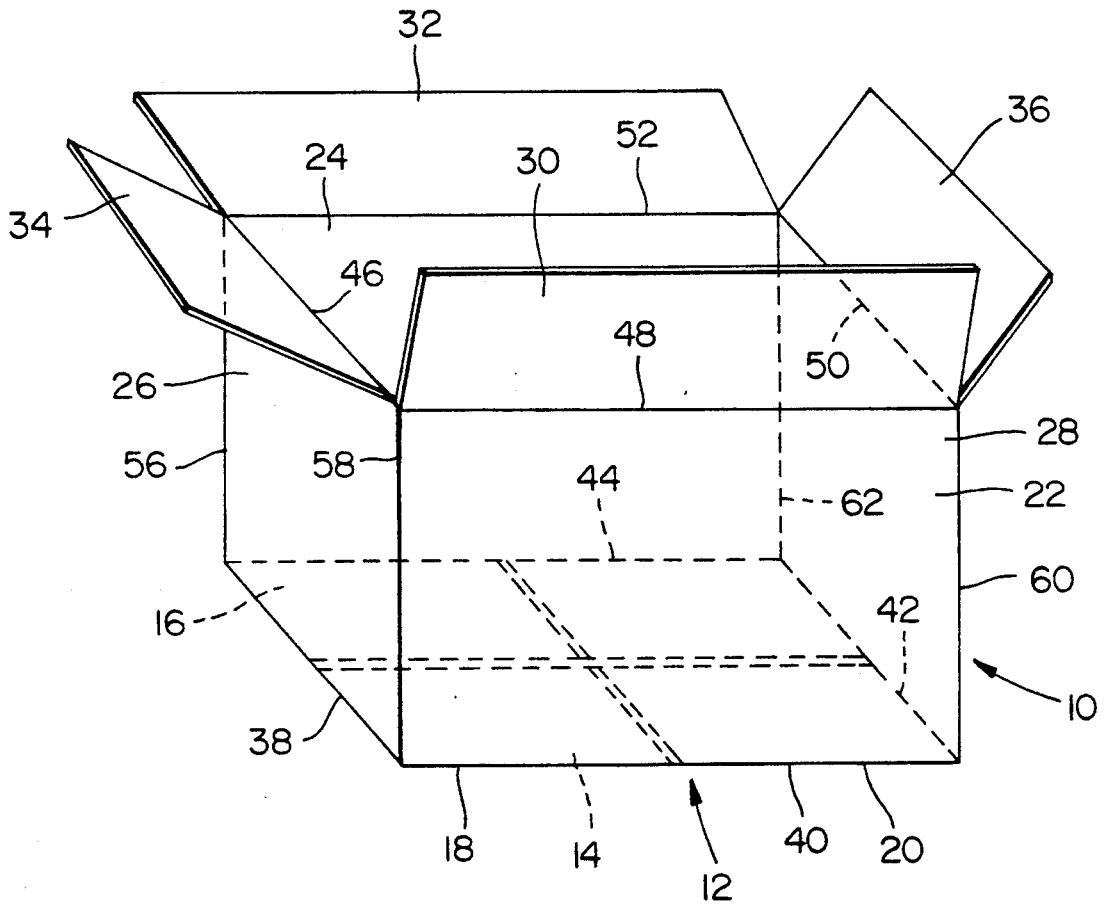
FIG. 1 is a perspective view of a corrugated cardboard box treated in accordance with the invention.

A known form of corrugated cardboard box 10 is of a type typically used for shipping consumer goods and suitable for stacking on a pallet during shipment, for example the box may be a regular slotted container (RSC). Typically, the box may be formed from a corrugated cardboard blank of known form which is folded about score-lines and glued where appropriate on the top and bottom. Thus, the box 10 has a base 12 formed from folded and glued flaps or panels 14 and 16 (extending left to right) and flaps or panels 18 and 20 extending front to back. The box further has a front wall 22, a rear wall 24 and side walls 26, 28. Flaps 30, 32, 34 and 36 are provided for closing the top of the box in known manner.

The blank from which the box is made has horizontal fold or score lines which in the completed box from the horizontal edges 38–52. Additionally the blank has vertical fold or score lines which form the four vertical box edges or corners 56–62.

In order to increase the compressive strength of the box in accordance with the invention each of the score lines defining the horizontal edges 38–52 is provided with mechanical perforations along substantially the entire length thereof preferably formed completely through the entire thickness of the cardboard linerboard layers. The perforations may, for example, comprise a row of spaced slits along the fold line each of a length about ¼"–⅝". The perforations may be formed before or after the box is folded.

Additionally, each of the vertical box edges 56–62 is chemically treated to enhance compression resistance by applying a bead of a suitable chemical composition, for example, a urea formaldehyde resin of ⅛" to 1" wide along substantially the entire length of the vertical edge. Such application may be effected after folding of the box and may be along the inside of the respective edge.

As noted above, and shown in the following examples, treatment of a box with both mechanical perforation of the horizontal edges and chemical treatment of the vertical edges surprisingly increases the compression strength to an extent substantially in excess of that which might be expected from an addition of the strength increases attributable to the individual treatments.

While only urea formaldehyde resin has been specifically referred to herein as a suitable chemical strength enhancer, the invention is not limited thereby. Other known chemical strength enhancers for paper and like products (both wet and dry strength) and which are normally impregnated into the material in known processes, can be used in the invention.

EXAMPLE 1

Box Strength Tests Comparing Treated and Untreated Boxes-May 14, 1990

Basis: Weyerhauser RSC Box: 200# C Flute for quarts of oil

Demonstrating the synergistic effect of combined chemical/mechanical treatments of a box to increase its compression strength by: 1. Chemical Treatment; 2. Mechanical Treatment and 3. A combination of chemical and mechanical treatments.

1. Chemical Treatment: A bead of either X2061 or X2062 formula was applied along the inside of each vertical fold of the box (T=Treated). Tests were run with both treated + untreated boxes.
2. Mechanical treatment: A series of perforations (small slits) through the entire sheet were made, along the score around the top and bottom edges of the box (HP=horizontal perforations).
3. Box received both chemical and mechanical treatment.

KEY TO SYMBOLS:

U=Untreated

T=Treated vertical scores with 1.8 grams per foot of X2061 or X2062 resin formulation.

HP=Horizontal scores were perforated

NSP=No scores perforated

WHOLE BOX COMPRESSION STRENGTH TESTS

| Sample No. | Formula NONE U NSP | X2061 T NSP | X2062 T NSP | NONE U HP | X2061 T HP | X2062 T HP |
|---|---|---|---|---|---|---|
| 1. | 62.8 | 64.0 | 62.8 | 73.6 | 84.5 | 84.2 |
| 2. | 58.2 | 66.6 | 70.7 | 73.4 | 81.3 | 79.4 |
| 3. | 60.2 | 67.2 | 67.7 | 67.0 | 90.2 | 79.3 |
| 4. | 58.2 | 73.5 | 66.4 | 70.5 | 86.5 | 86.5 |
| 5. | 61.0 | 68.3 | 67.0 | 78.0 | 82.4 | 92.7 |
| 6. | 59.3 | 66.7 | 66.5 | 80.0 | 84.6 | 84.8 |
| 7. | 61.5 | 65.4 | 65.6 | 69.4 | 81.0 | 79.3 |
| 8. | 61.8 | 67.0 | 70.4 | | 73.8 | 79.8 |
| 9. | 61.0 | | 64.7 | | 76.6 | 87.0 |
| 10. | 58.2 | | 65.6 | | | 87.4 |
| 11. | 65.0 | | | | | |
| 12. | 59.3 | | | | | |
| 13. | 59.4 | | | | | |
| Average | 60.5 | 67.3 | 66.7 | 73.1 | 82.3 | 84.0 |
| % Increase treated over untreated | 0.0 | 11.4% | 10.5% | 21.0% | 36.2% | 39% |

EXAMPLE 2

Box Strength Test Comparing Treated and Untreated Boxes-May 14, 1990

Basis: Weyerhauser RSC Box: 200# C Flute for quarts of oil

Demonstrating the synergistic effect of combined chemical/mechanical treatments of a box to increase its compressive strength by No. 1. Chemical Treatment; No. 2. Mechanical treatment; and No. 3. A combination of chemical and mechanical treatment.

1. Chemical treatment: A bead of X2062 formula was applied along the inside of each vertical fold of the box (Treated). Tests were run with both Treated and Untreated boxes.
2. Mechanical treatment: A Series of perforations (small slits) through the entire sheet were made at the score around the edge of the box (HP=horizontal perforations) or along the vertical scores (VP=vertical perforations), both both horizontal+ vertical scores (HP/VP).
3. Box receives both chemical treatment and mechanical treatment.

KEY TO SYMBOLS:

U=Untreated

T=Treated Vertical fold with 1.8 grams per foot of X2062 resin formula

HP=Horizontal scores were perforated

VP=Vertical scores were perforated

NSP=No scores perforated

WHOLE BOX COMPRESSION STRENGTH TESTS

| | TEST NO. | | | | | | | |
|---|---|---|---|---|---|---|---|---|
| | 1 | 2 | 3 | 4 | 5 | 6 | 7 | 8 |
| | A | | B | | C | | D | |
| Sample No. | U NSP | T NSP | U HP | T HP | U VP | T VP | U HP/VP | T HP/VP |
| 1. | 53.8 | 57.8 | 63.2 | 70.5 | 64.2 | 73.2 | 59.2 | 70.6 |
| 2. | 57.0 | 60.9 | 64.2 | 75.0 | 65.2 | 74.3 | 59.2 | 71.0 |
| 3. | 59.1 | 61.3 | 64.8 | 75.8 | 67.6 | 75.0 | 60.5 | 73.5 |
| 4. | 59.4 | 63.2 | 65.2 | 76.5 | 68.5 | 75.0 | 61.3 | 73.5 |
| 5. | 59.8 | 63.3 | 70.7 | 78.0 | 73.0 | 76.0 | 62.5 | 75.5 |
| 6. | 60.2 | 63.4 | 71.2 | 78.3 | 74.0 | 76.8 | 62.7 | 76.2 |
| 7. | 60.4 | 63.6 | 72.7 | 78.5 | 74.2 | 78.4 | 63.0 | 76.7 |
| 8. | 61.1 | 64.2 | 72.8 | 79.5 | 75.3 | 78.5 | 63.3 | 78.2 |
| 9. | 62.0 | 66.0 | 73.0 | 80.0 | 75.4 | 78.5 | 65.2 | 78.2 |
| 10. | 62.5 | 66.2 | 73.9 | 80.5 | 75.4 | 78.6 | 65.8 | 78.5 |
| 11. | 62.8 | 66.7 | 74.0 | 80.7 | 76.5 | 79.8 | 66.5 | 80.2 |
| 12. | 64.0 | 70.1 | 75.1 | 81.0 | 77.2 | 80.1 | 70.2 | 82.4 |
| 13. | 65.5 | | 75.6 | 81.0 | 80.3 | | | |
| 14. | | | 75.8 | | | | | |
| Average: | 60.6 | 63.9 | 70.9 | 78.1 | 72.8 | 77.0 | 63.3 | 76.2 |
| % inc. over Test 1 due to treatment | | 5.5 | | 10.2 | | 5.7 | | 20.4 |
| % inc. over Test 1 | 0.0 | 5.5 | 17.0 | 28.9 | 20.2 | 27.1 | 4.5 | 25.8 |

I claim:

1. A corrugated cardboard box comprising base panel means, upright walls, top panel means, horizontal edges between the base panel means and the walls, further horizontal edges between the top panel means and the walls, and vertical edges between the respective walls wherein compression strength of the box is increased by the provision of mechanical perforations extending through the cardboard along at least some of the horizontal edges, and a layer of a chemical strength enhancing additive extending along at least some of the vertical edges.

2. The invention of claim 1 wherein the perforations extend along substantially the entire length of each horizontal edge.

3. The invention of claim 1 wherein the layer of chemical additive extends along substantially the entire length of each vertical edge.

4. The invention of claim 1 wherein the chemical additive is a urea formaldehyde resin.

5. The invention of claim 1 wherein the chemical additive is on the interior of the respective vertical edge.

6. A method for increasing compression strength of a corrugated cardboard box having base panel means, upright walls, top panel means, horizontal edges between the base panel means and the walls, further horizontal edges between the top panel means and the walls and vertical edges between the respective walls, the method comprising perforating the cardboard along at least some of the horizontal edges and applying a layer of a chemical strength enhancing additive along at least some of the vertical edges.

7. The invention of claim 6 wherein the perforating step is applied substantially along the entire length of each horizontal edge.

8. The invention of claim 6 wherein the box is folded from a cardboard blank and the perforating step is effected before folding the blank.

9. The invention of claim 6 wherein the chemical additive is applied along substantially the entire length of each vertical edge.

10. The invention of claim 6 wherein the chemical additive is applied on the interior of the box.

* * * * *